US005921391A

United States Patent [19]

Ortiz et al.

[11] Patent Number: 5,921,391

[45] Date of Patent: Jul. 13, 1999

[54] CONTAINER FOR STORING AND TRANSPORTING WIRE, CORD AND THE LIKE

[75] Inventors: Norman Ortiz; James C. Greenlee, both of El Paso, Tex.

[73] Assignee: Stone Container Corporation, Chicago, Ill.

[21] Appl. No.: 08/979,472

[22] Filed: Nov. 26, 1997

[51] Int. Cl.[6] ..... B65D 85/04

[52] U.S. Cl. ..... 206/397; 206/407; 206/702; 242/137

[58] Field of Search ..... 206/702, 389, 206/395, 396, 407, 408, 413, 386, 600, 397; 229/106, 108; 242/160.1, 170, 171, 137, 136, 134

[56] References Cited

U.S. PATENT DOCUMENTS

| | | | |
|---|---|---|---|
| 2,565,188 | 8/1951 | Welshenbach . | |
| 2,713,938 | 7/1955 | Snyder | 206/395 |
| 2,943,732 | 7/1960 | Kovaleski et al. | 206/389 |
| 3,059,763 | 10/1962 | Eifrid | 206/395 |
| 3,314,586 | 4/1967 | Frank, Jr. | 206/395 |
| 3,563,448 | 2/1971 | Croley | 229/108 |
| 4,359,182 | 11/1982 | Perkin, Jr. | 229/108 |
| 4,623,063 | 11/1986 | Balkin | 206/395 |
| 5,390,790 | 2/1995 | Straub et al. . | |
| 5,409,110 | 4/1995 | Patent | 206/386 |

OTHER PUBLICATIONS

Photocopy of photographs of fiber, metal bound wire drum, made by Michael's Cooperage Co., 363 West Pershing Road, Chicago, Illinois 60609, believed at least as early as Nov. 1, 1996.

*Primary Examiner*—Paul T. Sewell
*Assistant Examiner*—Luan K. Bui
*Attorney, Agent, or Firm*—Dick and Harris

[57] ABSTRACT

A container for the transportation and/or temporary storage of filament like materials, such as wire, cord, rope and cable, fabricated preferably from corrugated paperboard material and comprising a cylindrical outer tube having a bottom wall at one end with a further cylindrical insert within the outer tube, defining an annular space therebetween. Portions of the bottom of the container apparatus are advantageously configured for facilitating handling of a filled one of the apparatus with fork lifts, hand operated floor jacks and the like.

15 Claims, 6 Drawing Sheets

CONTAINER FOR STORING AND TRANSPORTING WIRE, CORD AND THE LIKE

BACKGROUND OF THE INVENTION

1. The Technical Field

The present invention relates to apparatus for containing, storing and transporting elongated filament-like materials, such as cord, rope, wire or cable. In particular, the present invention is directed to reels, spools and/or drums for the transporting of large quantities of rope, wire or cable.

2. The Prior Art

When filament-like materials, such as electrical or telephone wire, or the like, are manufactured, they are typically originally manufactured in lengths which may be up to several thousands of yards, and are packed for transportation and temporary storage in a wound manner. Apparatus for transporting such relatively large lengths of filament material are known. Such apparatus include spools, reels or drums, which have been typically fabricated in the past from materials such as wood, plastic or metal.

A typical wooden spool, for example, will comprise two round disc-like members, joined at their centers by a transversely extending cylindrical core, which may or may not be hollow, depending upon the size of the overall spool structure. Because the weight of the thousands of yards of wire material, which may be wound upon such a spool may total several hundred pounds or more, the spool must be made in a robust manner, so that the spool, if made from wood, may itself weigh 50–100 or more pounds.

Such spools may alternatively be made from metal, for strength, but such metal fabricated reels or spools likewise may weigh 50–100 pounds or more.

Alternative apparatus for storing and transporting wire and the like may be in the form of a drum which typically will be a hollow cylindrical structure having a bottom into which the wire is laid in a circular manner to create a coil of material. A central post or pylon structure may be provided to facilitate maintaining the wire in a coil form.

The weight of such heavy spools or drums contributes to the overall combined weight of the package. Such additional weight limits the amount of the net weight of filament material which may be shipped in a given shipment. In addition, such wooden or metal reels, spools or drums may be expensive to fabricate. Accordingly, in an effort to recoup some of the expense of manufacture, once the wooden or metal spools, etc., are delivered to their ultimate destination and emptied, the spools, etc., are typically shipped empty back to the source, thus creating the additional expense of transporting the empty containers.

In an effort to reduce the weight of such containers, such containers may be and have been manufactured, at least in part, from plastic materials. However, such at least partially plastic containers likewise entail additional expense in their manufacture and additional expense associated with the reuse of such containers, through the transportation of empty containers back to their sources. In addition, containers incorporating plastic components in whole or in part may add to recycling difficulties and/or additional expense.

Still other prior art filament container apparatus may be drums fabricated from fibre materials, which are drum structures reinforced or bound at top and bottom by metal hoops or rings.

It would be desirable to provide a container for the transportation and/or temporary storage of elongated filament materials such as wire, cord, cable or rope which may be manufactured from relatively inexpensive materials.

It would additionally be desirable to provide a container for transporting and storing filament material which is relatively lightweight compared to prior art wood, metal and/or plastic apparatus.

It would additionally be desirable to provide such a container which may be fabricated from readily recyclable materials.

SUMMARY OF THE INVENTION

The present invention comprises a filament container apparatus for the containment, transportation and/or storage of filament materials. The filament container apparatus includes a substantially cylindrical hollow outer tube member, having a top end and a bottom end. A bottom member is operably associated with the outer tube member and disposed substantially adjacent the bottom end thereof, for substantially closing the bottom end of the outer tube member. An insert member, having a top end and a lower end, is insertably received within the outer tube member, and operably associated with the bottom member.

The outer tube member, bottom member and insert member operably define a substantially enclosed, cylindrical, annular region for the receipt and containment therewithin of the filament material.

Means are provided for facilitating handling of the filament container apparatus by lifting apparatus, said means for facilitating handling comprising at least one aperture region at the bottom end of the hollow outer tube member, for accommodating at least one longitudinally extending vertically movable tine for telescopic receipt thereof, upon alignment, by said at least one aperture.

In a preferred embodiment, the at least one aperture region comprises at least two aperture regions in the outer tube member, operably disposed in laterally spaced positions, substantially adjacent the bottom end thereof, operably configured for enabling at least two tines of a lifting apparatus to be insertably received therein, in supporting relationship to, the bottom member.

The substantially cylindrical hollow outer tube member further comprises a polygonal tube member. Preferably, the tube member is fabricated from a substantially flat blank of foldable material, having a plurality of elongated, substantially rectangular panels, with lines of weakness positioned between adjacent ones of the panels, the ends of which blank have been joined together.

The bottom member is operably positioned within the outer tube member, at a position vertically spaced from the bottom end of the outer tube member. The bottom member preferably comprises a bottom wall, operably positioned substantially perpendicular to a longitudinal axis of the filament container apparatus; and a plurality of bottom support members, operably emanating from a peripheral edge of the bottom wall and extending to the bottom end of the outer tube member.

Preferably, the plurality of bottom support members are positioned in overlying juxtaposed relation to respective portions of an inner surface of the outer tube member and affixed thereto. In a preferred embodiment of the invention, the bottom wall is fabricated in the form of a polygon.

The insert member comprises a polygonal tube member. The insert member preferably is fabricated from a substantially flat blank of foldable material, having a plurality of elongated, substantially rectangular panels, with lines of weakness positioned between adjacent ones of the panels, the ends of which blank have been joined together.

A plurality of support members emanate from respective ones of the panels forming the blank for the insert member and are positionable in positions substantially perpendicular to and radiating outwardly from a longitudinal axis of the outer tube member.

A ring insert member, operably positioned around the insert member, in the annular region between the insert member and the outer tube member, for maintaining the insert member in a substantially centered position, relative to the outer tube member.

Means are provided for supporting the bottom member, for substantially precluding buckling of the bottom member, when the filament container apparatus is loaded with filament material. The means for supporting the bottom member comprises at least one substantially vertically extending support wall member, operably positioned beneath a bottom wall of the bottom member. The at least one substantially vertically extending support wall member further comprises a plurality of support wall members operably arranged in the form of a polygon.

The apparatus may be fabricated from corrugated paperboard material.

BEST MODE FOR CARRYING OUT THE INVENTION

Figure 1:
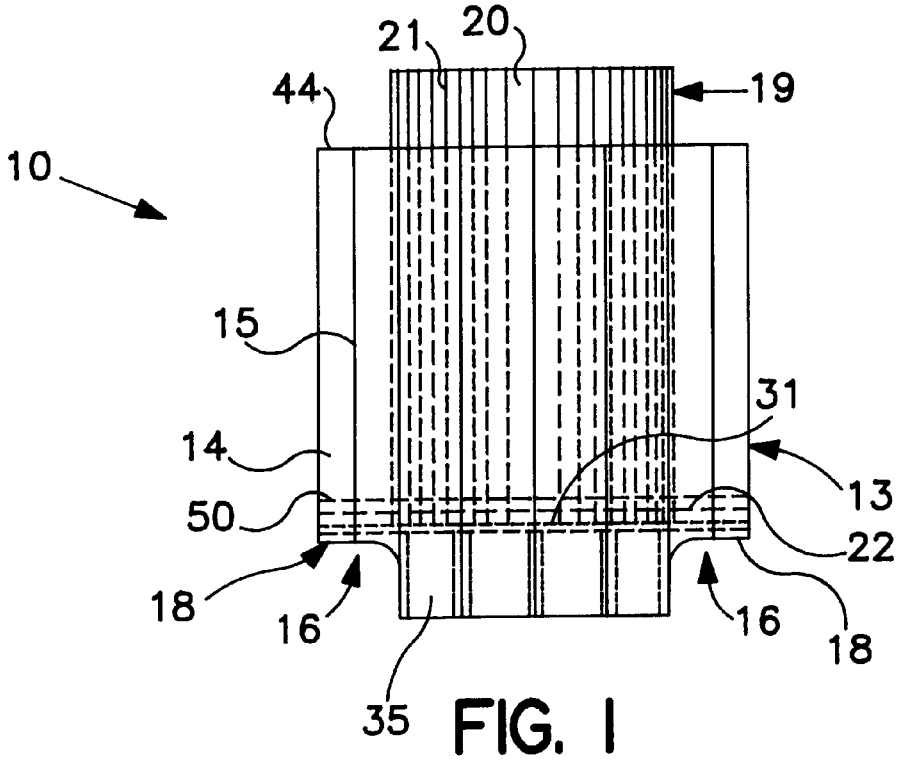
FIG. 1 is a front elevation of the container apparatus according to a preferred embodiment of the invention.

While this invention is susceptible of embodiment in many different forms, there is shown in the drawings and will be described in detail herein a specific embodiment, with the understanding that the present disclosure is to be considered as an exemplification of the principles of the invention and is not intended to limit the invention to the embodiment illustrated.

Figure 2:
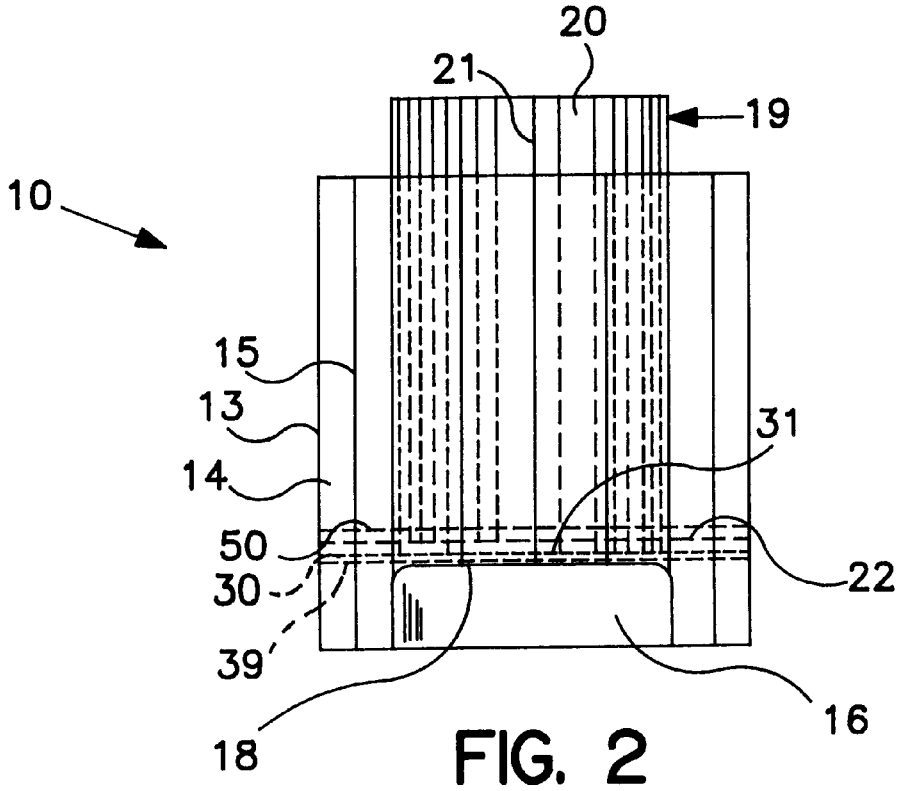
FIG. 2 is a side elevation thereof.

The filament container apparatus 10 according to a preferred embodiment of the invention is shown in front elevation in FIG. 1 and in a side elevation in FIG. 2. The several components making up filament container apparatus 10 are shown in an exploded view in FIG. 3.

Filament container apparatus 10 includes outer tube 13, which is provided with a plurality of rectangular or substantially rectangular elongated panels 14. Outer tube 13 is preferably formed from a foldable sheet material, such as corrugated paperboard material.

Figure 5:
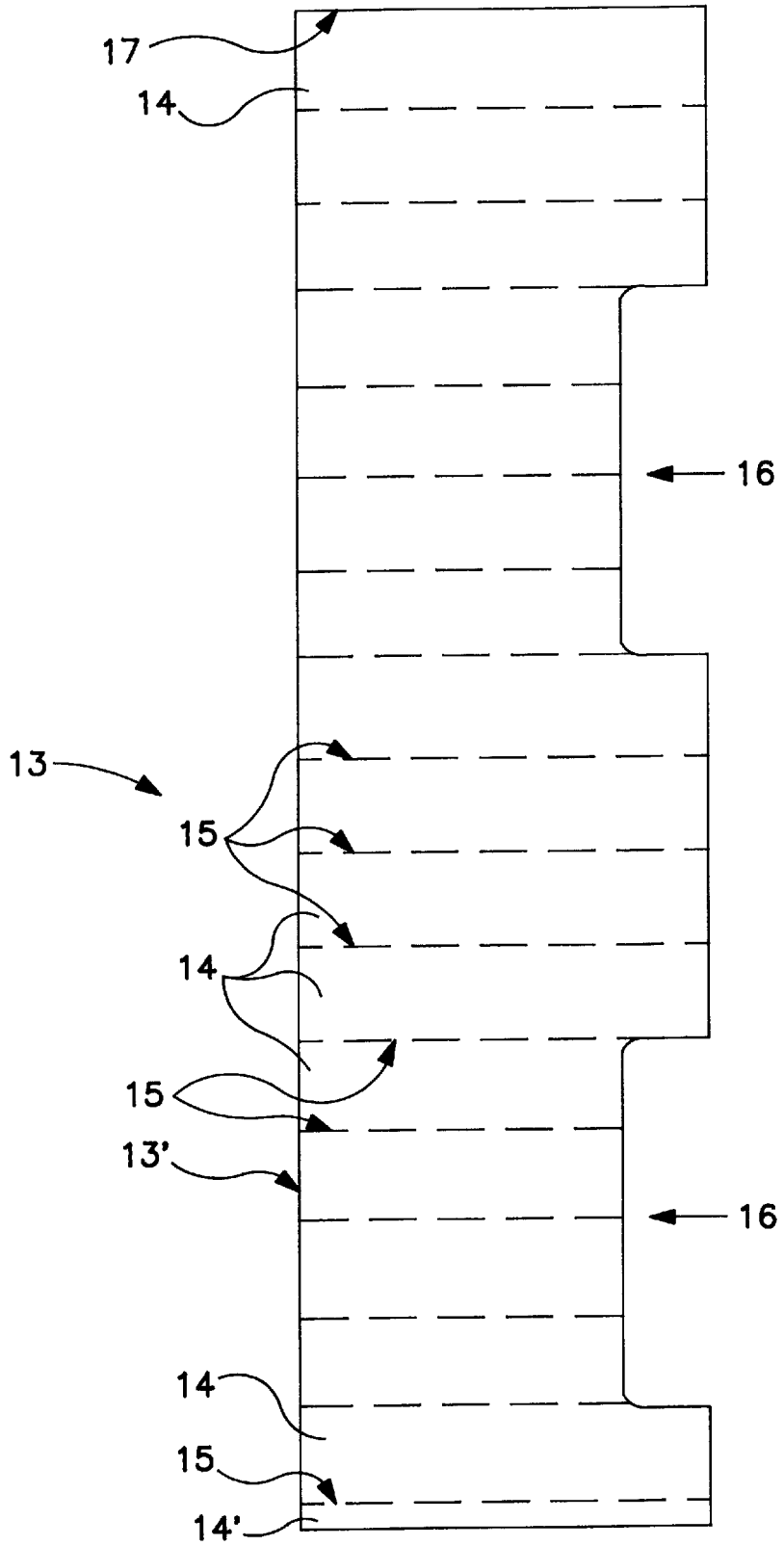
FIG. 5 is a plan view of a blank for forming the outer tube of the container apparatus.
Figure 6:
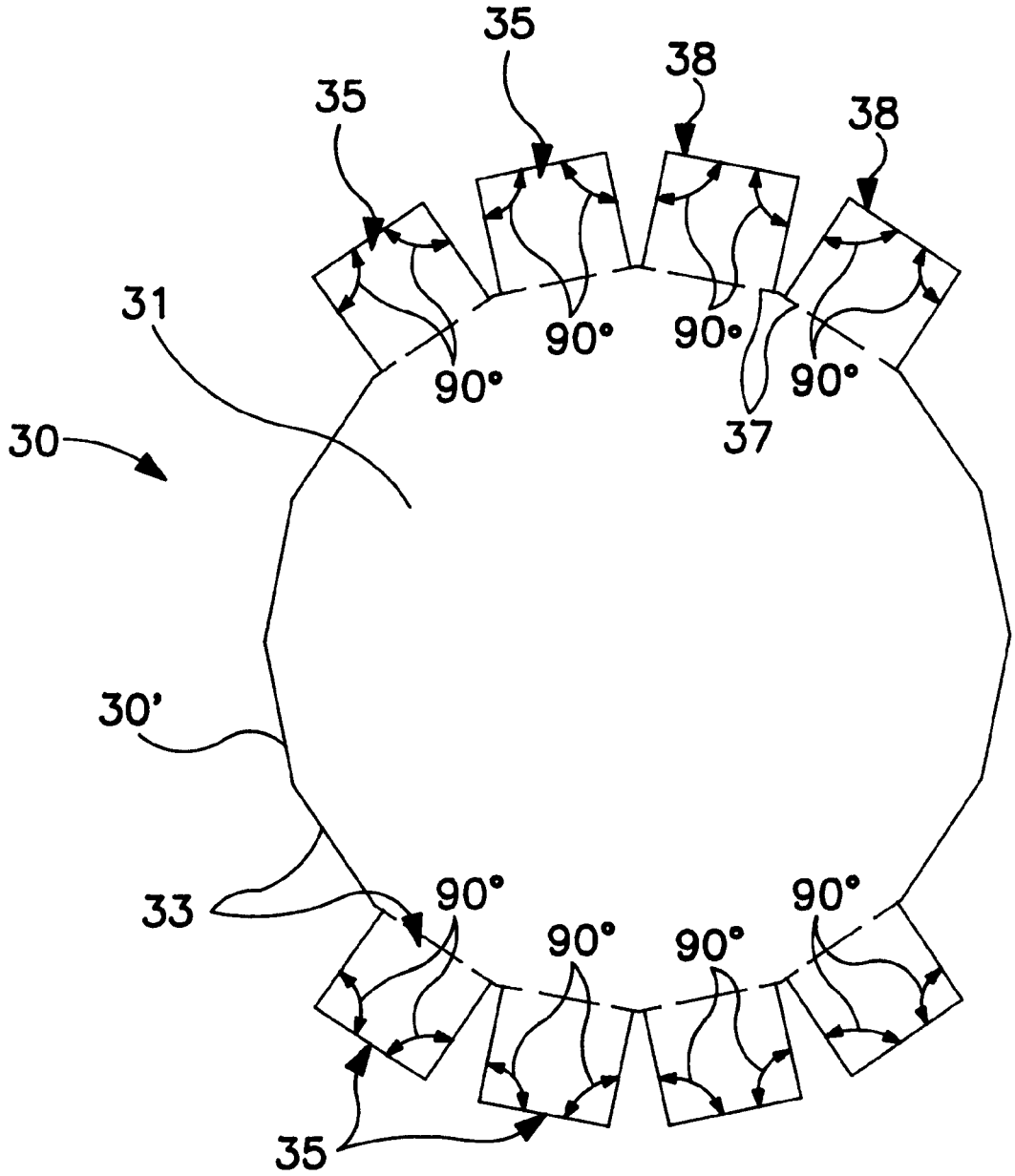
FIG. 6 is plan view of a blank for forming the bottom of the container apparatus.

FIG. 5 illustrates the blank 13' for forming outer tube 13, according to a preferred embodiment of the invention. In a preferred embodiment of the invention, blank 13' is divided into a plurality of panels 14 which are rectangular or substantially rectangular. In the embodiment of the present invention, sixteen panels 14 are provided, each having the same width. Panels 14 are separated by fold lines 15. A tab 14' is provided at one end of blank 13'. Two substantially rectangular cut out regions 16 are formed in blank 13'. To form outer tube 13, blank 13' is folded successively along each of fold lines 15 until a polygonal cylindrical tube is formed. Tab 14' is fitted in overlying relation to the panel 14 adjacent end edge 17 so that the fold line 15 between tab 14' and its adjacent panel 14 is substantially aligned with end edge 17. Preferably, tab 14' will occupy the radially inward position relative to the overlying panel 14. Affixation of tab 14' to the end panel 14 preferably is accomplished by the use of adhesive, although staples or similar affixation methods may also be used. The resultant structure will be a polygonal tube having sixteen sides with substantially equal angles between each adjacent pair of panels 14.

Figure 7:
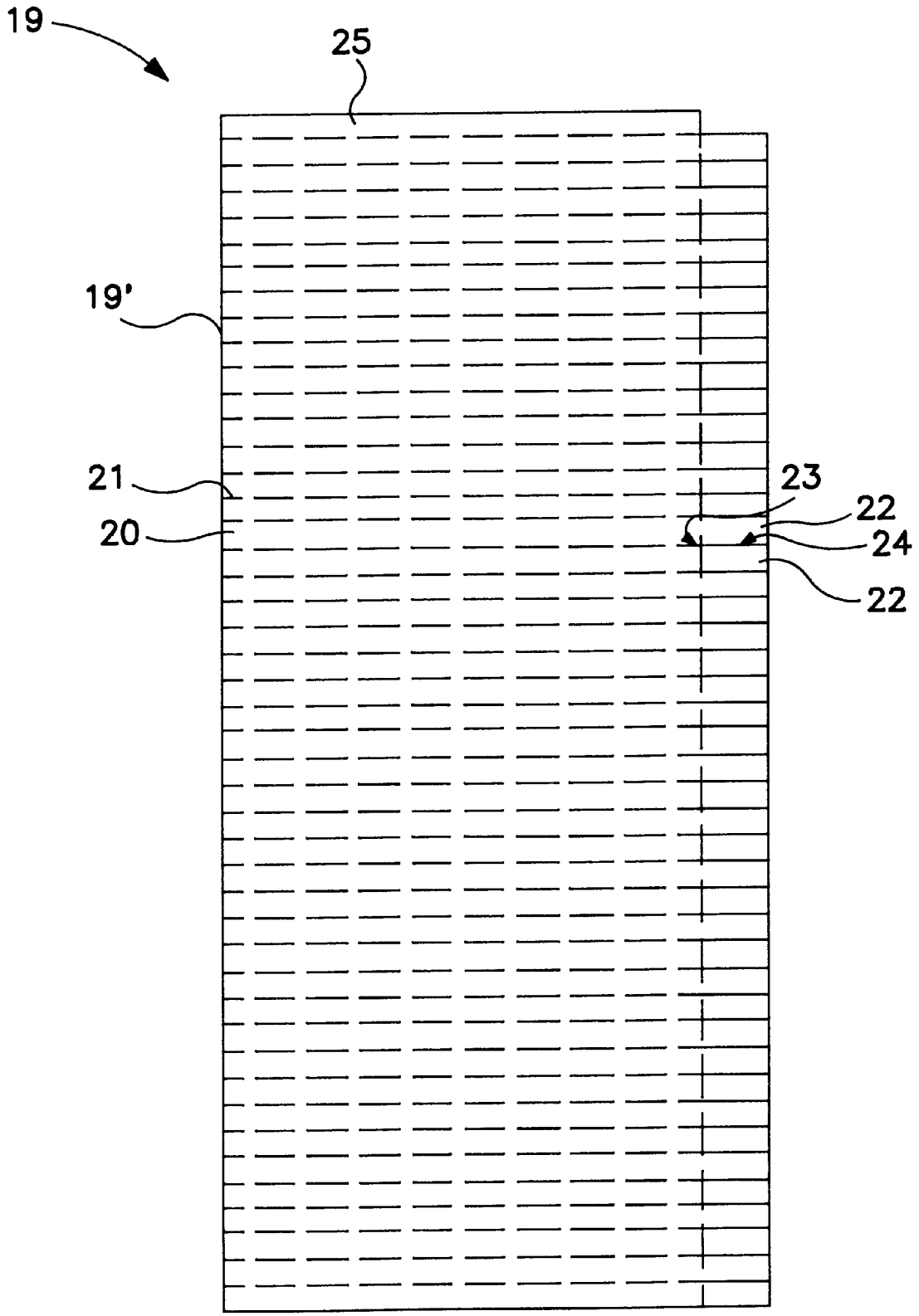
FIG. 7 is a plan view of a blank for forming the cylindrical insert for the container apparatus.
Figure 8:
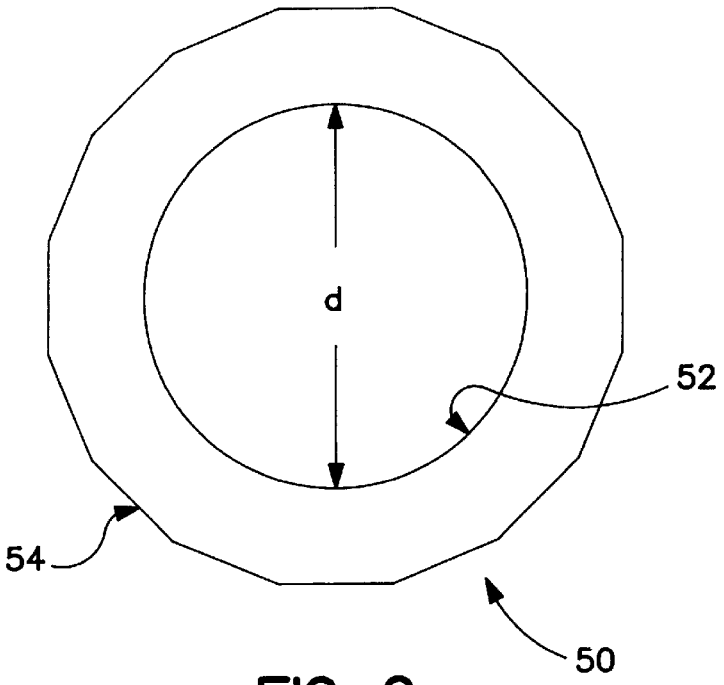
FIG. 8 is a plan view of a blank for forming the ring insert for the container apparatus.

Insert 19 is similarly formed from a blank 19' (see FIG. 7). Blank 19' is preferably formed from a foldable sheet material, such as corrugated paperboard material.

Figure 3:
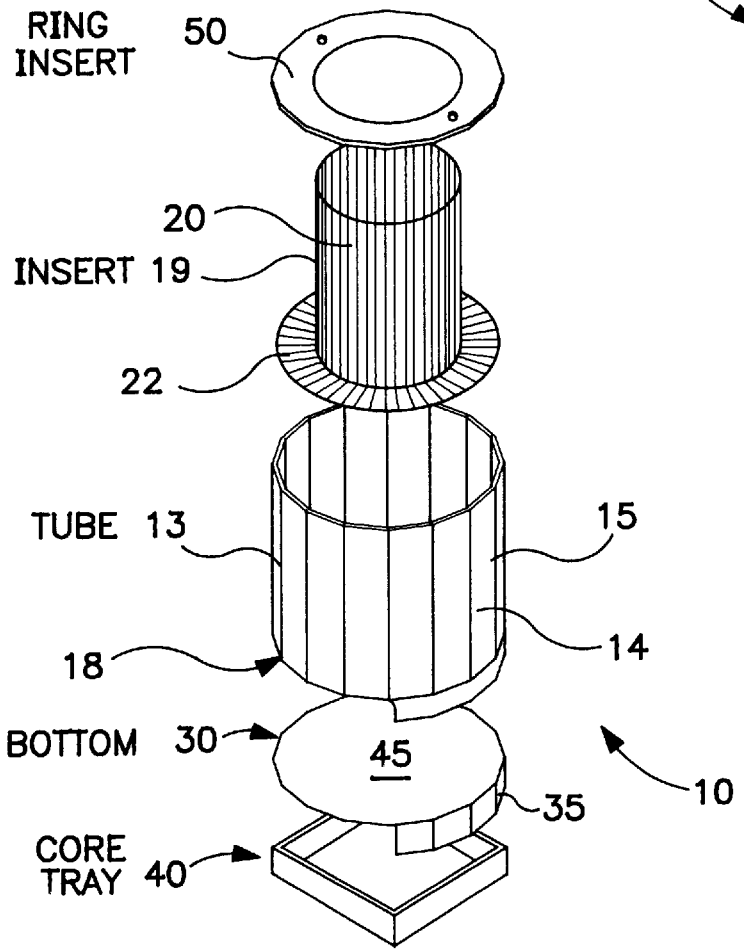
FIG. 3 is an exploded perspective view of the components comprising the container apparatus.

Blank 19' is divided into a plurality of panels 20 separated by fold lines 21. Each respective panel 20 has an end tab 22. A fold line 23 separates each panel 20 from its tab 22. Adjacent tabs 22 are separated from one another by cuts 24 and end tab 25 is provided at one or the other end of blank 19'. To form insert 19, blank 19' is folded along each of fold lines 21, in a manner similar to that described with respect to outer tube 13. Preferably, end tab 25 is positioned in underlying relationship to the panel 20 at the opposite end of blank 19' and affixed thereto, preferably by adhesive, although other affixing methods, such as staples, may be used. In a preferred embodiment of the invention, forty-five panels 20 are provided, although that number may be increased or decreased, as desired, in accordance with the requirements of the particular application for the device being fabricated. Once blank 19' has been folded and affixed to itself, a polygonal cylindrical tube is formed. Each of the ends tabs 22 is folded along its respective fold line 23 relative to its respective panel 20, as shown in FIG. 3, so that each end tab 22 occupies a position substantially perpendicular to the longitudinal axis of insert 19.

Bottom 30 is preferably formed from a blank 30'. Blank 30' is preferably formed from a foldable sheet material, such as corrugated paperboard material.

Blank 30' has a bottom wall 31, which is substantially polygonal in configuration, and provided, in a preferred embodiment of the invention, with sixteen sides 33. Feet 35 emanate from eight of the sides 33, with fold lines 37 separating each foot 35 from its respective side 33. Each of the feet 35 is preferably rectangular in configuration and may be square if desired.

Bottom 30 is attached to tube 13 by folding each of the feet 35 along its respective fold line 37 until each foot is substantially perpendicular to the plain of the bottom wall 31. So folded, bottom 30 is inserted into the already formed outer tube 13 with the feet aligned with the corresponding eight longest ones of the panels 14 in outer tube 13. Bottom 30 is inserted until the free edges 38 of each of feet 35 are substantially flush with the adjacent edges of the corresponding panels 14 of outer tube 13. The feet 35 are then affixed to the overlying portions of the corresponding panels 14, by adhesive, staples, etc. In a preferred embodiment of the invention, the vertical height of the cut-out regions 16 in outer tube 13 is such that the lower surface 39 of bottom wall 31 of bottom 30 will be slightly higher or flush with the upper edge 18 of each of cut-out region 16.

Figure 9:
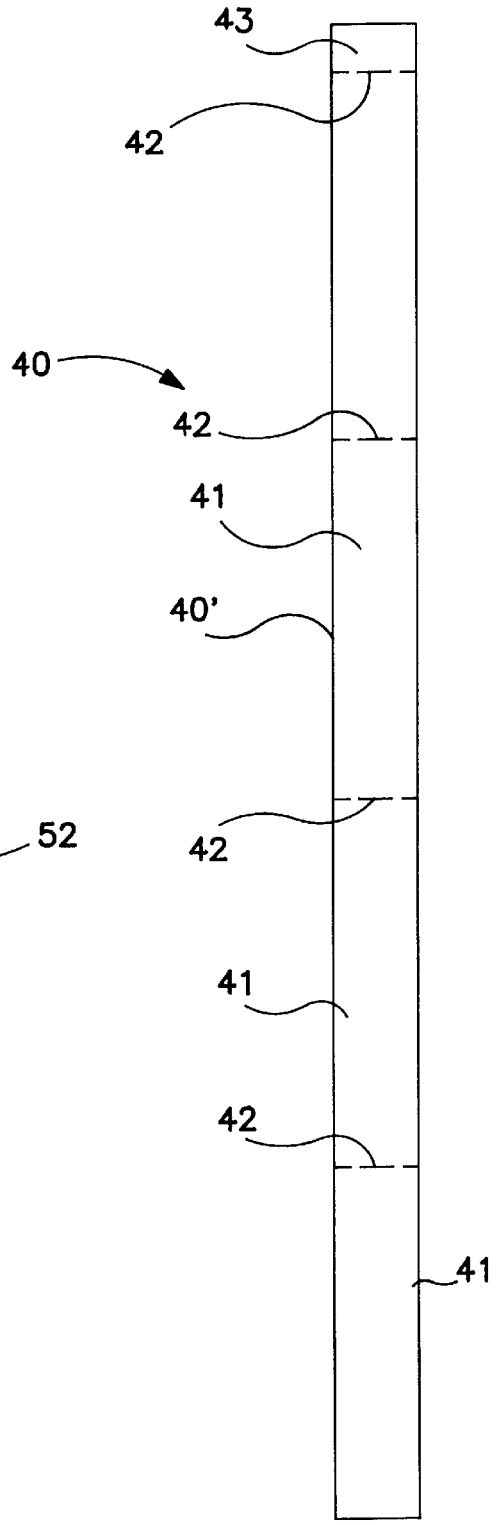
FIG. 9 is a plan view of a blank for forming the core tray for the bottom of the container apparatus.

A core tray 40 is preferably formed by an elongated blank 40' (see FIG. 9). Blank 40' is preferably formed from a foldable sheet material, such as corrugated paperboard material.

Figure 4:
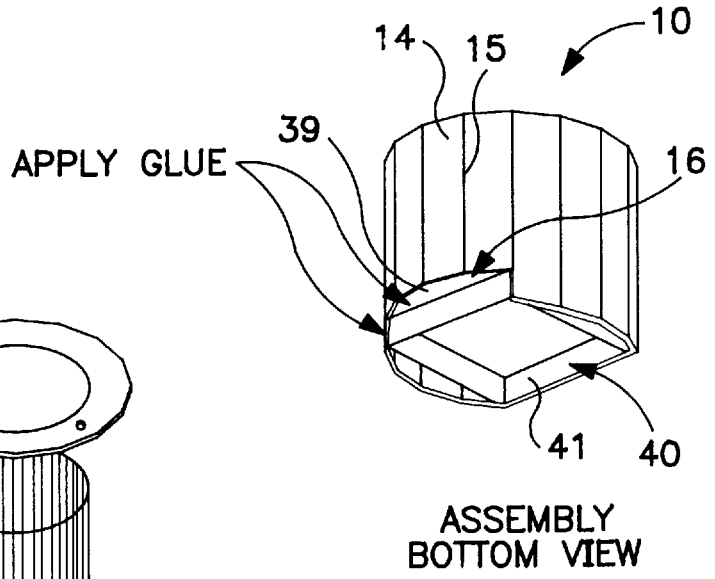
FIG. 4 is bottom perspective view of the assembled container apparatus.

Blank 40' is divided into four panels 41 separated by fold lines 42 and end tab 43 is positioned at one end of blank 40'. Tray 40 is formed by folding the several panels 41 along their respective fold lines 42, with end tab 43 underlying the panel 41 at the opposite end of blank 40'. Tab 43 is affixed to the opposing panel 41 by adhesive, staples, etc., in the manner previously described, so that a rectangular or square tray 40 is formed. Tray 40 is affixed, preferably by adhesive, to the underside 39 of bottom 30 as shown in FIG. 4. The panels 41 of tray 40 may be appropriately sized so that the corners of tray 40 substantially align with the end edges of the cut-out regions 16, as shown in FIG. 4. Alternatively, the lengths of panels 41 may be smaller so that tray 40 is centered in the bottom surface 39 of bottom 30, without touching either seat 35 or the ends of panels 14.

After tube 13, bottom 30 and tray 40 have been assembled and affixed to one another, tube 13 is positioned in an upright orientation, and insert 19 is insertably positioned within tube 13 to rest on the upper surface 45 of bottom 30. As shown in FIGS. 1 and 2, panels 20 of insert 19 have a length which is greater than the distance from the edges 18 to the top edges 44 of panels 14, so that insert 19 projects above tube 13.

Ring insert 50 is preferably formed as an annular flat member preferably having a circular center aperture 52 which has a diameter which is slightly greater than the diameter of the assembled insert 19. Ring insert 50 is preferably provided on its outer periphery with a plurality of sides 54 which are the same in number as the number of panels 14 in outer tube 13. Once insert 19 has been positioned within assembled outer tube 13, insert ring 50 is fitted over panels 20 of insert 19 and slid downward on top of end tabs 22. Insert ring 50 may be appropriate sized to fit snugly around insert 19 and snugly within tube 13, though a tighter or looser fit may be provided if desired. Insert ring 50 serves to center insert 19 within tube 13. Insert 19 and/or insert ring 50 may be affixed to bottom wall 31 of bottom 30 is desired, although they may be only inserted and held in place by friction, if so desired.

Once the filament container apparatus 10 has been fully erected and assembled, filaments, such as wire, cord, rope, cable, etc., may be loaded into filament container apparatus 10 in a manner substantially similar to that in which such materials are loaded into conventional wooden, metal or plastic drums, in that the filament material is paid out in a circular fashion, winding the paid out filament around insert 19 in the annular space between insert 19 and outer tube 13 to form a coil. Once the loading has been completed, a further insert ring 50 may be positioned over insert 19, to form a cap for covering the loaded material, if desired, to help preclude the intrusion of dust, dirt, etc., into the coiled and loaded filament material.

Handling of the loaded filament container apparatus is facilitated by the cut out regions 16 which, in a preferred embodiment of the invention, will be sized and spaced apart, as shown in FIG. 1, so that the distance between cut-out section 16 is substantially the same as the distance between the tines of a conventional fork lift or hand operated floor jack device.

Preferably, each of the tube 13, insert 19, bottom 30, core tray 40 and ring insert 50, are all formed from corrugated paperboard material. In particular, a multiwall corrugated material may be used, having two layers of fluted medium sandwiched between three layers (outer, middle, inner) of sheet material. In a preferred embodiment of the invention, one of the layers of fluted medium may have an amplitude which is greater than the other. The use of such a material enables filament container apparatus 10 to be fabricated in a relative inexpensive manner, as compared to prior art wooden, plastic or metal filament container apparatus. In addition, filament container apparatus 10, when fabricated from such materials, is of substantially lighter weight than prior art wood, plastic or metal filament container apparatus. In addition, the cost of the substantially lower cost reuse of the filament container apparatus 10 is not required in order to make filament container apparatus 10 cost effective, so that each filament container apparatus 10 may be discarded after a single use. By fabricating filament container apparatus 10 out of materials such as corrugated paperboard material, each filament container apparatus 10 may be readily recycled.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

We claim:

1. A filament container apparatus for the containment, transportation and storage of coiled filament materials, comprising:

a substantially cylindrical hollow outer tube member, having a top end and a bottom end;

a bottom member operably associated with the outer tube member and disposed proximate the bottom end thereof, for substantially closing the bottom end of the outer tube member, the bottom member including a substantially planar surface member which is vertically spaced from an extreme bottom edge of the outer tube member, by at least one vertically extending bottom support member operably connected to a bottom surface of the substantially planar surface member, the at least one bottom support member being operably spaced inwardly from at least portions of the inner surface of the outer tube member, to reinforce the strength of the bottom member;

an insert member, having a top end and a lower end, insertably received within the outer tube member, and operably associated with the bottom member;

the outer tube member, bottom member and insert member operably defining a substantially enclosed, cylindrical, annular region for the receipt and containment therewithin of said filament materials;

means for facilitating handling of the filament container apparatus by lifting apparatus, said means for facilitating handling comprising at least one aperture region proximate the extreme bottom end of said hollow outer tube member for accommodating at least one longitudinally extending vertically movable tine for telescopic receipt thereof, upon alignment, by said at least one aperture, said outer tube member, bottom member, insert member and means for facilitating handling of the filament container apparatus by lifting apparatus being operably positioned for maintaining said filament materials in a substantially upright orientation coiled about an axis which is substantially upright when said filament container apparatus is in cooperative engagement with one of said lifting apparatus, having said at least one longitudinally extending vertically movable tine.

2. The filament container apparatus according to claim 1, wherein the at least one aperture region comprises:

at least two aperture regions in the outer tube member, operably disposed in laterally spaced positions, substantially adjacent the bottom end thereof, operably configured for enabling at least two tines of a lifting apparatus to be insertably received therein, in supporting relationship to the bottom member.

3. The filament container apparatus according to claim 1, wherein the substantially cylindrical hollow outer tube member further comprises a polygonal tube member.

4. The filament container apparatus according to claim 3, wherein the substantially cylindrical hollow outer tube member is fabricated from a substantially flat blank of foldable material, having a plurality of elongated, substantially rectangular panels, with lines of weakness positioned between adjacent ones of the panels, for enabling relative folding of said adjacent ones of the panels, about said lines of weakness, the ends of which blank have been joined together.

5. The filament container apparatus according to claim 1, wherein the bottom member comprises:

a bottom wall, operably positioned substantially perpendicular to a longitudinal axis of the filament container apparatus;

a plurality of bottom support members, operably emanating from a peripheral edge of the bottom wall and extending to the bottom end of the outer tube member.

6. The filament container apparatus according to claim 5, wherein the plurality of bottom support members are positioned in overlying juxtaposed relation to respective portions of an inner surface of the outer tube member and affixed thereto.

7. The filament container apparatus according to claim 5, wherein the bottom wall is fabricated in the form of a polygon.

8. The filament container apparatus according to claim 1, wherein the insert member comprises a polygonal tube member.

9. The filament container apparatus according to claim 8, wherein the insert member is fabricated from a substantially flat blank of foldable material, having a plurality of elongated, substantially rectangular panels, with lines of weakness positioned between adjacent ones of the panels, for enabling relative folding of said adjacent ones of the panels, about said lines of weakness, the ends of which blank have been joined together.

10. The filament container apparatus according to claim 9, wherein a plurality of support members emanate from respective ones of the panels forming the blank for the insert member and are positionable in positions substantially perpendicular to and radiating outwardly from a longitudinal axis of the outer tube member.

11. The filament container apparatus according to claim 9, further comprising a ring insert member, operably positioned around the insert member, in the annular region between the insert member and the outer tube member, for maintaining the insert member in a substantially centered position, relative to the outer tube member.

12. The filament container apparatus according to claim 1, wherein the at least one bottom support member further comprises:

a plurality of support wall members operably arranged in the form of a polygon.

13. The filament container apparatus according to claim 1, wherein the apparatus is fabricated from corrugated paperboard material.

14. The filament container apparatus according to claim 13, wherein the apparatus is fabricated from multiwall corrugated paperboard material.

15. The filament container apparatus according to claim 1, wherein the at least one bottom support member forms a side wall of the at least one aperture region.

* * * * *